US006228230B1

(12) United States Patent
Li et al.

(10) Patent No.: US 6,228,230 B1
(45) Date of Patent: May 8, 2001

(54) ELECTROPLATING APPARATUS

(75) Inventors: Xiang-Ming Li; Tom w. Lamayeau; Kenneth McMasters Wallace; Bruce W. Hess; William DeoGracias; Daniel H. Chang, all of San Diego, CA (US)

(73) Assignee: AEM, Inc., San Diego, CA (US)

( * ) Notice: Subject to any disclaimer, the term of this patent is extended or adjusted under 35 U.S.C. 154(b) by 0 days.

(21) Appl. No.: 09/294,993

(22) Filed: Apr. 19, 1999

(51) Int. Cl.[7] ..... C25D 17/00

(52) U.S. Cl. ..... 204/222; 204/273; 204/275; 204/237

(58) Field of Search ..... 204/222, 273, 204/275, 237

(56) References Cited

U.S. PATENT DOCUMENTS

| | | | | |
|---|---|---|---|---|
| 3,397,126 | * | 8/1968 | Gilbert | 204/222 X |
| 4,572,773 | | 2/1986 | Fallot | 204/201 |
| 4,696,728 | | 9/1987 | Birkle et al. | 204/213 |
| 5,124,016 | | 6/1992 | Barbier | 204/222 |
| 5,173,169 | * | 12/1992 | Garrison et al. | 204/222 X |
| 5,217,598 | | 6/1993 | Sawa | 205/148 |
| 5,433,834 | * | 7/1995 | Belz et al. | 204/213 |
| 5,487,824 | | 1/1996 | Griego | 205/128 |
| 5,490,917 | | 2/1996 | Lazaro et al. | 205/143 |
| 5,817,220 | | 10/1998 | Chen | 204/213 |
| 5,851,368 | * | 12/1998 | Rumph | 204/213 |

* cited by examiner

*Primary Examiner*—Donald R. Valentine
(74) *Attorney, Agent, or Firm*—Procopio, Cory, Hargreaves & Savitch LLP; Kam W. Li

(57) ABSTRACT

An apparatus for electroplating small parts comprises an electroplating bath for holding an electrolyte and electroplating anodes. The apparatus includes a container having at least one screened parts compartment for holding the parts to be electroplated, and incorporates an electrically conductive screen as its base portion, on which the parts are settled. The conductive screen is adaptable to be connected to the negative pole of a power supply to function as the cathode. A pump circulates freshly ionized electrolyte into the parts compartment and directs a flow of the electrolyte to periodically tumble the parts in the parts compartment. Thereafter, the parts are shaken by a shaker to level the parts to maximize the surface and electrical contact between the parts and the screen when they are settled on the screen. In alternative embodiments of the invention, the container can be of perforated panel construction. Also, the container can include a divider to partition the container into a plurality of parts compartments for electroplating a variety of different parts.

16 Claims, 3 Drawing Sheets

Fig. 2
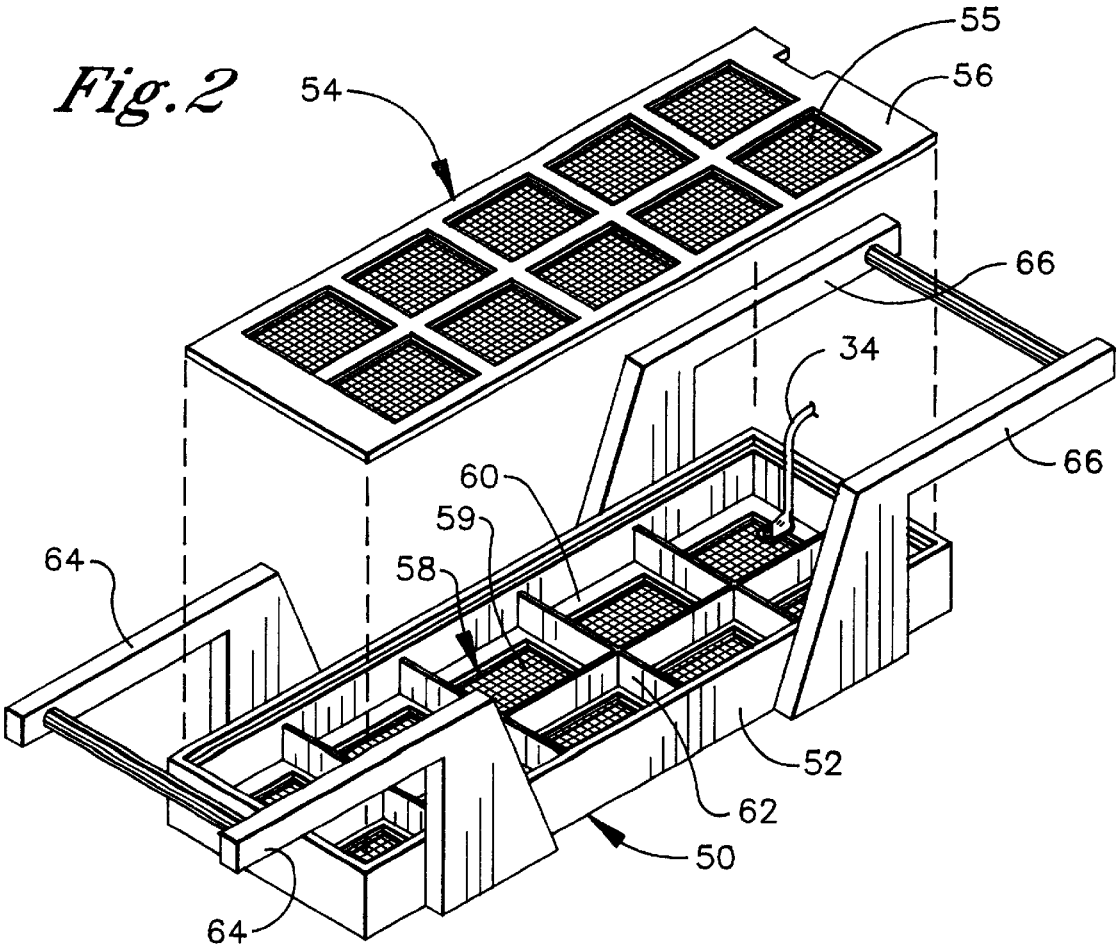
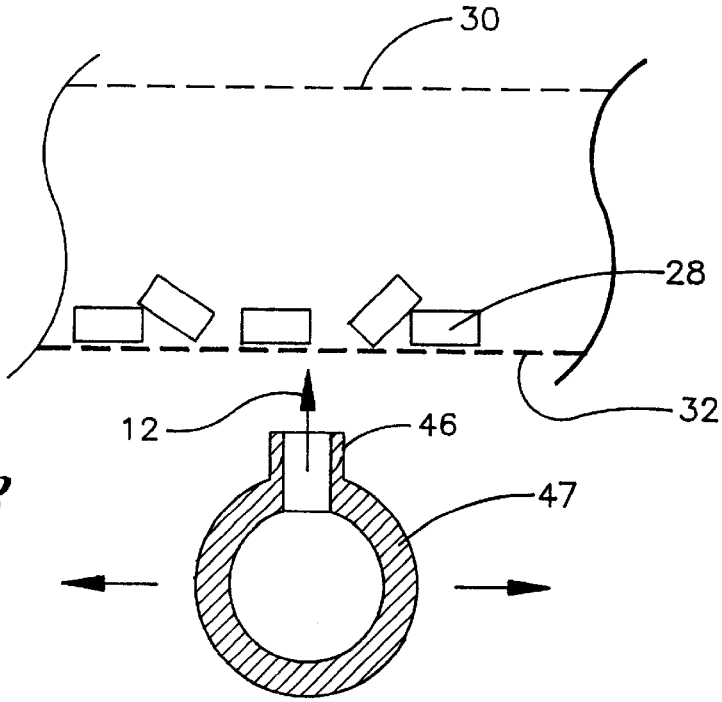
Fig. 3

ELECTROPLATING APPARATUS

FIELD OF THE INVENTION

This invention relates to an electroplating apparatus. More particularly, this invention relates to an apparatus for electroplating of small parts.

BACKGROUND OF THE INVENTION

In electroplating process, the parts to be plated are connected to the cathode (negative pole) of a DC power supply. An anode with the metal used in plating is connected to the anode (positive pole) of the DC power supply. The parts to be plated and the anode with the metal used in plating are immersed in an electroplating solution containing metal ions. When the power supply is turned on, the metal ions are reduced and deposited on the surface of the parts to form a metal film. The metal on the anode is oxidized and dissolved in the plating solution to replenish the metal ions in the solution.

For electroplating of large parts, the parts are typically suspended on a rack that is connected to the cathode of the power supply. However, for electroplating of small parts including electronic components, suspension of the parts on a rack often is impractical due to their small sizes and large quantities.

For electroplating of small parts, there are various disclosures in the prior art which seek to overcome the size and quantity limitations. For example, U.S. Pat. No. 5,490,017 discloses an electroplating process wherein small parts are placed in a rotating plating barrel. Another example is contained in U.S. Pat. No. 5,817,220, which discloses a rotatable cage employing a parts container. While these designs provide for agitation of the small parts in order to achieve increased uniformity of plating, rotational plating has numerous significant drawbacks.

During rotational plating, as suggested in the above-referenced examples, the parts and the conductive media tend to segregate due to differences in shape, size, and mass, which reduces the plating uniformity on the parts and the overall quality of the production run. Often, the plating solution or electrolyte, which is in contact with the parts and conductive media, is not well mixed with the bulk solution. A typical drawback of the prior art is a lack of plating uniformity along the surface area of the parts. Further, a significant portion of the metal is deposited on the media, resulting in excessive use of metal and electricity thereby causing wastage. Additionally, in plating of some soft metal parts, such as lead and tin, the tumbling with media causes smearing of the soft metals and extension of plating to the non-metalized portion of the parts. Furthermore, separation of the parts and media following rotational plating and maintenance of the media used in such plating are time consuming tasks.

In view of the aforementioned deficiencies within the prior art, it will be desirable to have an apparatus for electroplating small parts which maximizes plating uniformity. It will be further desirable to electroplate small parts in a manner which exhausts the least amount of anode metal and electricity. It will be advantageous to be able to electroplate small soft metal parts in a manner which decreases smearing and unwarranted deposit of metals on the non-metalized portions of such parts and to avoid the time consuming tasks of separating parts and media after plating and maintaining the media used in barrel plating.

SUMMARY OF THE INVENTION

According to the present invention, an electroplating apparatus for small parts is provided. The apparatus comprises an electroplating bath for holding an electrolyte and electroplating anodes, which is adaptable to be connected to a source of positive electrical charge.

The parts to be electroplated are enclosed in a container that is immersable in the electrolyte. The container has at least one screened compartment for holding the parts to be electroplated, and the compartment incorporates an electrically conductive screen as its base portion, on which the parts are settled. The conductive screen is connected to the negative pole of a power supply to function as the cathode.

A fluid transport means circulates freshly ionized electrolyte into the parts compartment and directs a flow of the electrolyte to periodically tumble the parts in the compartment. Thereafter, the parts are shaken by a shaker to level the parts to maximize the surface and electrical contact between the parts and the screen when they are settled on the screen.

In the embodiment of the invention, the tumbling and shaking of the parts can be undertaken sequentially. The tumbling can be carried out for a predetermined period of time to enable part separation from the cathode, which is then followed by the actuation of the shaker and the settlement of the parts. In alternative embodiments of the invention, the container can be of perforated panel construction. Also, the container can include a divider to provide a plurality of parts compartments for electroplating a variety of different parts.

These and other aspects and advantages of the invention will become apparent from the following detailed description, and the accompanying drawings, which illustrate by way of example the features of the invention.

BRIEF DESCRIPTION OF THE DRAWINGS

FIG. 2 is an exploded perspective view of a representative tray of the present invention for holding the parts for electroplating;

FIG. 3 is diagrammatic view of a representative jet which supplies electroplating fluid for tumbling the parts in a parts compartment of the present invention.

DETAILED DESCRIPTION OF THE PREFERRED EMBODIMENT

The electroplating apparatus of the present invention is a highly effective and versatile apparatus for electroplating small parts, particularly small electrotonic components, with increased uniformity and efficiency of electroplating while avoiding the problems of having the parts being smeared or otherwise damaged as evidenced in the prior art.

Figure 1:
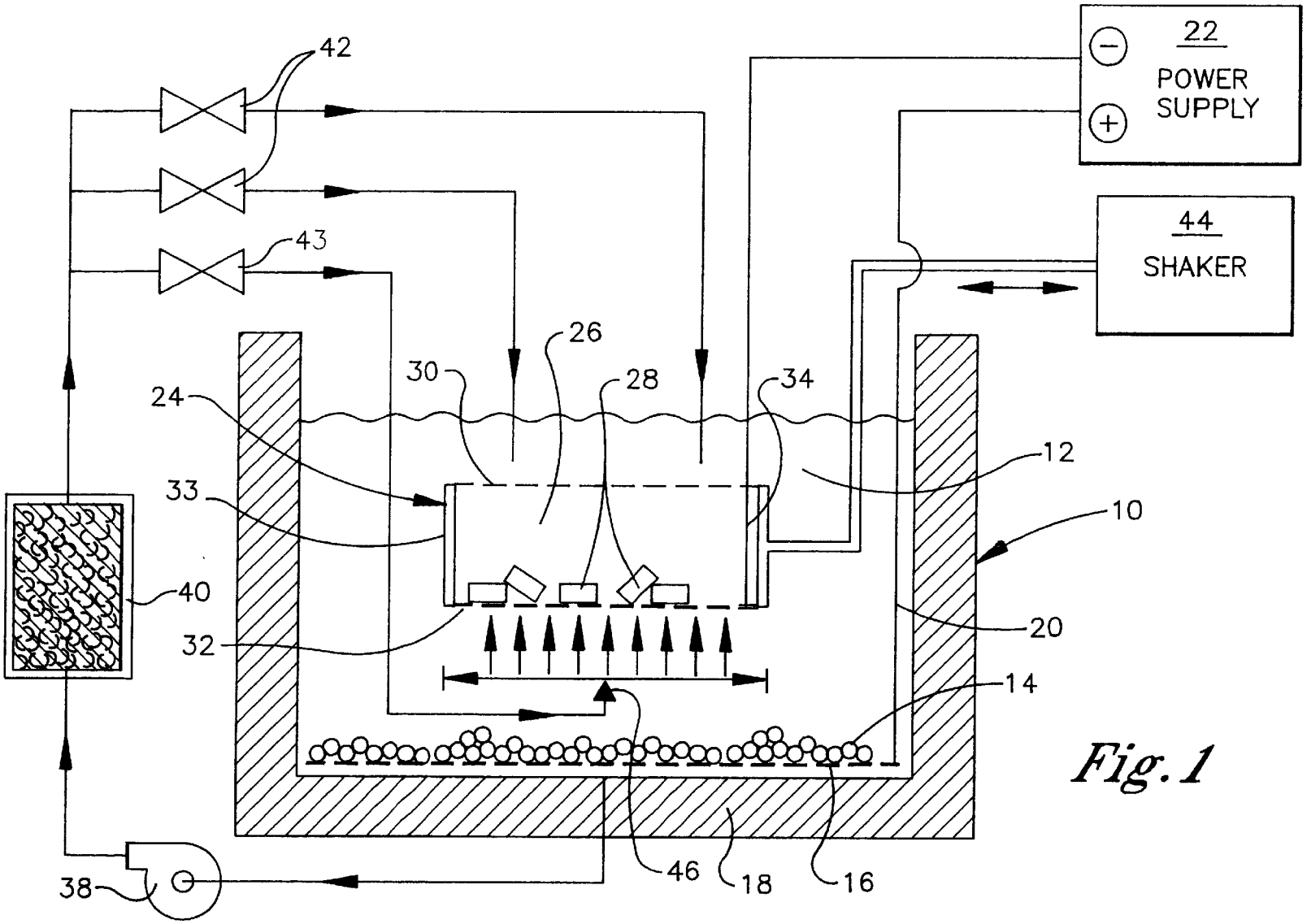
FIG. 1 is a diagrammatic view of the electroplating apparatus of the present invention.

The electroplating apparatus is depicted in diagrammatic form as shown in FIG. 1. The apparatus comprises an electroplating tank or bath 10 which is adaptable for holding a electroplating solution or electrolyte 12. Electroplating anodes 14 are immersed in the electrolyte 12 to replenish the anodic ions in the electrolyte which are depleted during electroplating process.

For ease of handling and debris removal, anodes 14 are placed on an anode shelf 16, which is disposed at the lower portion of bath 10. Anode shelf 16 is made of an electrically conductive material having openings which are smaller in size than the anodes 14 which are prevented from falling to the bottom portion of the bath 10. The anode shelf 16 is supported in a slightly elevated position from the base 18 of the bath 10 to allow debris to fall to the bottom of the bath 10. To facilitate cleaning and debris removal, the anode shelf 16 is removable from the bath 10.

The anodes can be dispensed and replaced in small portions or in bulk, depending on the particular application. For bulk or batch replacement, the anodes can be placed optionally in a basket in lieu of placement on the open anode shelf 16 as illustrated in FIG. 1.

The anode shelf 16 is coupled to a terminal strap 20 which is adaptable to be connected to a source of positive charge or positive pole of a power supply 22. When the anode shelf 16 is energized with the positive charge, the anodes that are in contact with anode shelf 16 will also be electrically charged. Power supplies and controls suitable for electroplating applications are well-known in the art. Therefore, the choice of any particular design or construction for energizing the present electroplating apparatus is not detailed here.

The present invention is provided with a container 24 for holding the parts to be electroplated. Container 24 is adapted for immersion in the electrolyte 12 in the electroplating bath 10. As shown in FIG. 1, Container 24 has a upper screen 30, a lower screen 32, which forms the base of container 24, and side walls 33 which define an enclosed parts compartment 26 in fluid communication with bath 10. Both the upper screen 30 and the lower screen 32 have openings smaller than the size of the parts 28 which are held within parts compartment 26. The upper screen 30 can be opened or removed for parts dispensing or removal.

Alternatively, in lieu of screen construction, either one or both of the upper and lower screens can be made of a perforated panel having openings smaller than the size of the parts.

The lower screen 32 of container 24 is made of an electrically conductive material which is coupled to a terminal strap 34 adaptable to be connected to a source of negative charge from the power supply 22. Thus, when energized, lower screen 32 functions as a cathode to effect electroplating of the parts 28 that are in contact with the lower screen 32.

Alternatively, an electrical conductor, such as a wire strip or a wire mesh, can be positioned above the lower screen 32 and coupled to the terminal strap 34 to impart the negative charge to the parts 28. In such alternative embodiment, the lower screen can be made of non-electrically conductive material.

The electroplating apparatus of the present invention is equipped with a fluid transport means for circulating the electrolyte 12 to ensure that the electroplating apparatus is provided with a constant supply of electrolyte. This reduces localized or uneven concentration of the ions within any particular portion of the electroplating apparatus system.

As illustrated in FIG. 1, in the parts compartment 26, the parts 28 are free to settle on the lower screen 32. However, on settlement, some of the parts might not develop electrical contact with the cathode to be electrically charged as required to induce electroplating. To ensure that the parts will be exposed to electrical contact with the lower screen 32, the fluid transport means is adapted to provide periodic fluidic tumbling of the parts 28, after which they will be allowed to settle. The gentle fluidic tumbling substantially reduces the risks of the parts being smeared or damaged as evidenced in the prior art. Each successive fluidic tumbling and subsequent parts settlement on the lower screen 32 increases the probability that the individual parts will each develop electrical contact with the cathode. Therefore, such unique aspect of the present invention enhances the overall uniformity of the plating on the individual parts and improves the overall quality of the production run.

The fluid transport means of the present invention includes a pump 38, which is fluidicly connected to the lower portion of bath 10 by an appropriate tubing or pipe. The pump withdraws the electrolyte 12 from the lower portion of bath 10 and circulates it through the electroplating apparatus system. The locality of the electrolyte withdrawal, which is in proximity to the anodes, ensures a supply of freshly ionized solution. The pump 38 carries the electrolyte 12 through a filter 40 where debris or other impurities from the electrolyte are removed from the electroplating apparatus system. From the filter 40, a portion of the electrolyte 12 is reintroduced into the bath 10 through valves 42. Another portion of the electrolyte is passed through a fluid jet 46 to effect periodic tumbling of the parts 28. The fluid jet is disposed adjacent the lower screen 32 of the container as depicted in FIG. 1 to direct an upward flow of the electrolyte to effect fluidic tumbling of the parts 28. The flow rate of the electrolyte exiting the jet is regulated by valve 43. Additionally, valve 43 can be actuated by a timer (not shown) so that the fluidic tumbling can be carried out in a periodic manner as discussed above. To further enhance thorough fluid tumbling, jet 46 can be carried by a mechanism 45 which traverses the length of the lower cover 32 of the parts compartment 26. After the parts have been tumbled, they are allowed to settle in contact with the negatively charged lower cover 32 within the parts compartment to resume electroplating.

The present invention is provided with a shaker 44 that is attached to Container 24 as shown in FIG. 1. Following periodic tumbling, the shaker 44 is actuated to provide gentle shaking of the parts 28, which levels the parts upon their settling on the lower screen 32 thereby providing maximum surface contact between the parts and the lower screen 32 and increasing the efficiency of the electroplating apparatus.

While electrolyte circulation within the electroplating apparatus system is carried out continuously, fluidic tumbling and shaking of the parts compartment are undertaken sequentially. Preferably, jet 46 is operated for a predetermined period of time to enable sufficient tumbling, which is then followed by the actuation of the shaker. Thereafter, the parts are allowed to settle for resumption of electroplating.

The flow rate of the electrolyte and the extent of the jet movement for fluidic tumbling, as well as the magnitude of the shaking, can be controlled to achieve optimal results. Because different metals and applications would require different levels of plating thickness, the frequency and time duration of successive parts tumbling, shaking and subsequent settlement can be controlled to produce the desired level of plating thickness and quality of the production run.

Figure 4:
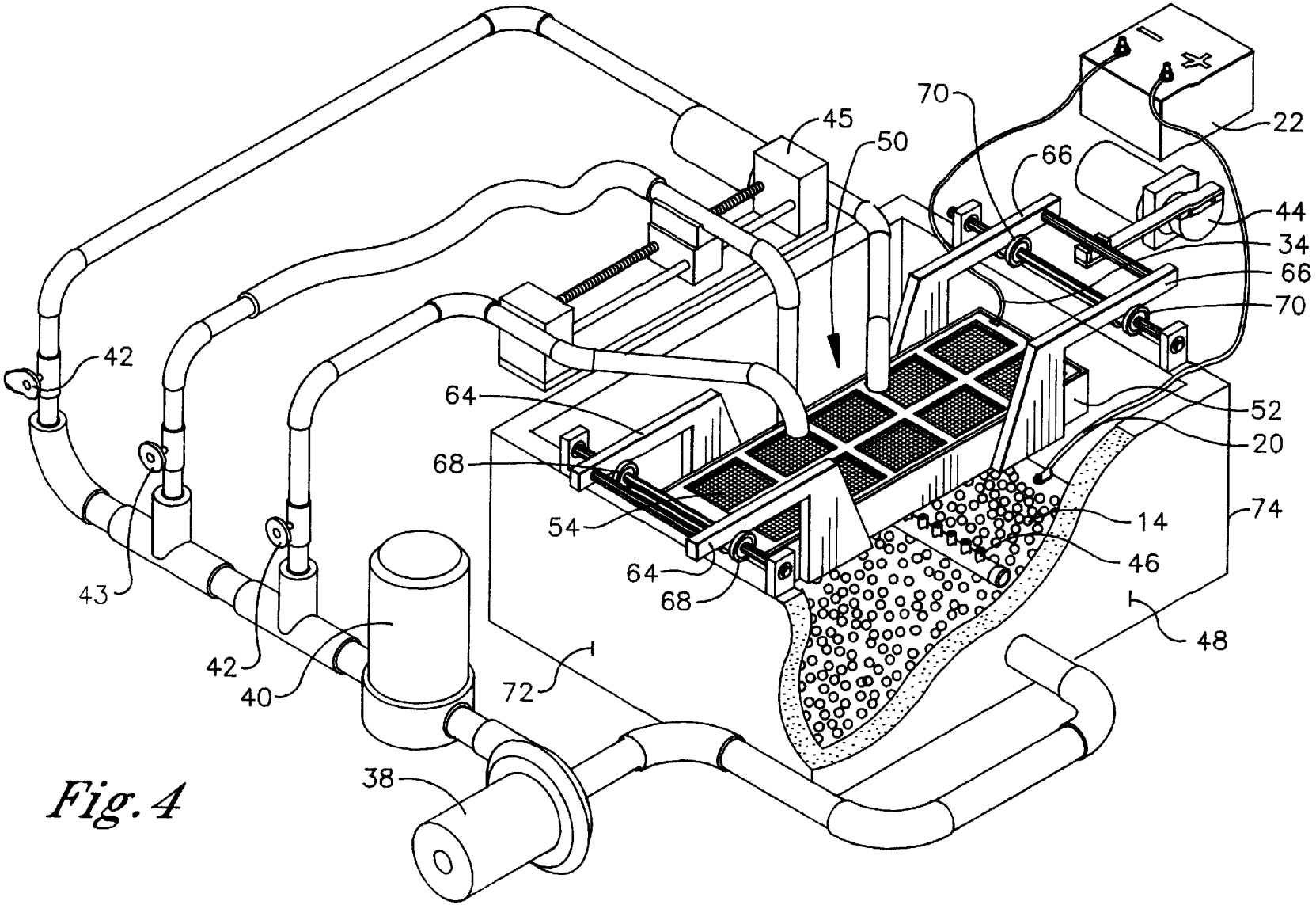
FIG. 4 is an exploded perspective view of a representative embodiment of the electroplating apparatus of the present invention.

FIGS. 2 and 4 illustrate another embodiment of the present invention, wherein a container or tray 50 is provided for electroplating a variety of parts. Tray 50 includes a frame 52, a removable upper panel 54 and a lower panel 58 forming an enclosure or parts compartment for holding the parts to be electroplated. Both the upper panel 54 and the lower panel 58 are perforated such that the parts compartment for holding the parts is in fluid communication with the electroplating bath 48.

Disposed between the upper panel 54 and lower panel 58 is a divider 62, which partitions the space between the upper panel and the lower panel into a plurality of parts compartments. The plurality of parts compartments available enables concurrent electroplating of different parts. The divider 62 serves as a barrier which prevents migration of the parts from one compartment to another. Thus, this embodiment of the present invention, which provides for a plurality of parts compartments, enables simultaneous electroplating of different parts without any commingling, and eliminates the time-consuming tasks of parts separation when the process is complete. This lends convenience and efficiency in the use of the electroplating apparatus of the present invention, which substantially facilitates the dispensing and removal of different parts undergoing electroplating.

Similar to the upper screen 30 and lower screen 32 of the container 24 as illustrated in FIG. 1, each of the upper panel 54 and lower panel 58 can be made of one-piece screen construction with openings smaller in size than that of the parts. Alternately, as shown in FIG. 2, screen 55 and screen 59 can be mounted on frame grids 56 and 60 respectively to form an upper screened panel and a lower screened panels. In the embodiment shown in FIGS. 2, and 4, screen 59 is made of electrically conductive material and is coupled to the terminal strap 34 to accept a negative charge from the power supply 22 such that screen 59 functions as a cathode for the electroplating apparatus. As shown in FIGS. 2 and 4, tray 50 is provided with upraised brackets 64 and 66 which are supported by roller guides 68 and 70 atop the opposite side walls 72 and 74 of the electroplating bath 48. When immersed in the electrolyte within the bath 48, the tray 50 is suspended downwardly by the roller guides. Similar to the embodiment as shown in FIG. 1, the embodiment as shown in FIGS. 2 and 4 is provided with a shaker 44 that is attached to bracket 66 of the tray 50. The bracket is engaged by the shaker to provide gentle shaking of the parts 28 within the individual parts compartments of tray 50 which follows the periodic fluidic tumbling of the parts 28 by jet 46. A variety of shakers are commercially available. A suitable shaker for use in the present invention can be of eccentric construction driven by an electrical motor to induce the shaking motion.

In the embodiment as shown in FIG. 4, the jet 46 is arranged as a plurality of nozzles on a header 47, which is disposed below the tray 50 to provide an upward flow of electrolyte for thorough tumbling of the parts. The header 47 in turn is carried by the moving mechanism 45 which is adapted to move back and forth traversing the length of the tray 50 in a horizontal manner. Moving mechanisms are readily available commercially. Therefore, the selection is not detailed here.

From the above description, it is apparent that the present invention is represented by a highly effective and versatile apparatus for electroplating small parts with increased uniformity and efficiency of electroplating while avoiding the problems of having the parts being smeared or otherwise damaged as evidenced in the prior art.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. An apparatus for electroplating parts comprising:

(i) a bath for holding an electrolyte and an anode adapted for immersion in the electrolyte;

(ii) a container adapted for immersion within the bath and defining a parts compartment for holding the parts to be electroplated, the container having a plurality of small openings to permit fluid communication between the bath and the parts compartment;

(iii) cathode adaptable to conduct electrical charge and disposed in contact with the parts in the parts compartment; and (iv) fluid transport means for moving the electrolyte between the bath and the parts compartment, wherein the fluid transport means further comprises at least one nozzle positioned below the container to direct an upward flow of the electrolyte to effect fluidic tumbling of the parts.

2. The apparatus for electroplating parts according to claim 1 wherein the anode comprises materials selected from the group consisting of tin, lead, nickel, copper, silver, gold, and alloys thereof.

3. The apparatus for electroplating parts according to claim 1 wherein the cathode comprises an electrically conductive screen having a plurality of openings which are smaller in size than the size of the parts.

4. The apparatus for electroplating parts according to claim 3 wherein the electrically conductive screen forms the base of the container.

5. The apparatus for electroplating parts according to claim 1, wherein the container includes a removable upper screen, a lower screen forming the base of the container and having a plurality of openings smaller in size than the size of the parts and side walls defining the parts compartment.

6. The apparatus for electroplating parts according to claim 5, wherein the cathode includes an electrical conductor adjacent the lower screen.

7. The apparatus for electroplating parts according to claim 5, wherein the lower screen is made of an electrically conductive material.

8. The apparatus for electroplating parts according to claim 1 wherein said fluid transport means comprises a pump fluidicly coupled to the bath and is adapted to be activated periodically to tumble the parts.

9. The apparatus for electroplating parts according to claim 1 which further comprises charging means electrically coupled to the anode and the cathode to effect electroplating of the parts.

10. The apparatus for electroplating parts according to claim 1 which further comprises a shaker for shaking the parts.

11. The apparatus for electroplating parts according to claim 10, wherein the tumbling of the parts precedes the shaking of the parts.

12. The apparatus for electroplating parts according to claim 11, which further comprises a timer to effect periodic fluidic tumbling and shaking of the parts.

13. An apparatus for electroplating parts comprising:

(i) a bath for holding an electrolyte and an anode adapted for immersion in the electrolyte;

(ii) a container adapted for immersion within the bath and having a plurality of parts compartment for holding the parts to be electroplated, the container having a plurality of small openings to permit fluid communication between the bath and the parts compartment;

(iii) cathode adaptable to conduct electrical charge and disposed in contact with the parts in the parts compartment; and (iv) fluid transport means for moving the electrolyte between the bath and the parts compartment, wherein the fluid transport means further comprises at least one nozzle positioned below the container to direct an upward flow of the electrolyte to effect fluidic tumbling of the parts.

14. The apparatus for electroplating parts according to claim 13 wherein the container includes a removable upper screened panel, a lower screened panel having a plurality of openings smaller in size than the size of the parts and forming the base of the container, side walls defining the parts compartment and a divider disposed between the upper screened panel and the lower screened panel defining the plurality of the parts compartments.

15. The apparatus for electroplating parts according to claim 14 wherein the cathode includes an electrical conductor adjacent the lower screened panel.

16. The apparatus for electroplating parts according to claim 14, wherein the lower screened panel is made of an electrically conductive material.

* * * * *